United States Patent [19]

Clements et al.

[11] Patent Number: 5,074,440

[45] Date of Patent: Dec. 24, 1991

[54] CONTAINER FOR DISPENSING PRESERVATIVE-FREE PREPARATIONS

[75] Inventors: Don A. Clements; Fred M. Killinger, both of Arlington, Tex.

[73] Assignee: Alcon Laboratories, Inc., Fort Worth, Tex.

[21] Appl. No.: 552,991

[22] Filed: Jul. 16, 1990

[51] Int. Cl.[5] ..... B67D 5/58

[52] U.S. Cl. ..... 222/189; 222/213; 222/496; 239/288.3

[58] Field of Search ..... 222/189, 212, 213, 494, 222/495, 496, 420; 239/104, 288, 288.3

[56] References Cited

U.S. PATENT DOCUMENTS

| | | | |
|---|---|---|---|
| 1,752,085 | 6/1928 | Hinkle . | |
| 2,187,564 | 4/1938 | Bagley | 221/32 |
| 2,752,199 | 12/1954 | Newell | 299/90 |
| 2,812,117 | 3/1955 | Butkus et al. | 222/189 |
| 2,830,740 | 11/1955 | Landis | 111/179 |
| 3,105,618 | 10/1963 | Whitley | 222/212 |
| 3,130,877 | 4/1964 | Miller | 222/212 |
| 3,141,579 | 7/1964 | Medlock | 222/212 |
| 3,149,758 | 11/1961 | Bush et al. | 222/189 |
| 3,215,350 | 11/1965 | Hetrick | 239/104 |
| 3,358,883 | 3/1966 | Loe | 222/86 |
| 3,756,478 | 9/1973 | Podell et al. | 222/420 |
| 3,952,902 | 4/1976 | Prouty et al. | 215/306 |
| 4,093,124 | 6/1978 | Morane et al. | 222/189 |
| 4,159,790 | 7/1979 | Bailey | 222/211 |
| 4,239,132 | 12/1980 | Mueller et al. | 222/212 |
| 4,259,954 | 4/1981 | Scott | 128/248 |
| 4,340,157 | 7/1982 | Darner | 222/211 |
| 4,533,068 | 8/1985 | Meierhoefer | 222/189 |
| 4,694,976 | 9/1987 | Schuetz | 222/189 |
| 4,728,037 | 3/1988 | Mainhardt | 239/154 |
| 4,732,325 | 3/1988 | Jensen et al. | 239/288 |
| 4,736,890 | 4/1988 | Wallington | 239/288 |
| 4,739,906 | 4/1988 | LoTurco | 222/153 |
| 4,749,108 | 6/1988 | Dornsbusch et al. | 222/212 |
| 4,760,937 | 8/1988 | Evezich | 222/95 |
| 4,798,311 | 1/1989 | Workum | 222/131 |
| 4,917,271 | 4/1990 | Kanner et al. | 222/189 |

FOREIGN PATENT DOCUMENTS

| | | | |
|---|---|---|---|
| 99526 | 2/1962 | Norway | 222/496 |

*Primary Examiner*—Michael S. Huppert
*Assistant Examiner*—Kenneth Bromberg
*Attorney, Agent, or Firm*—Zarley, McKee, Thomte, Voorhees & Sease

[57] ABSTRACT

A multiple use container for dispensing fluids, particularly preservative free preparations in variable doses, includes a squeezable container for holding the fluid. A dispenser assembly associated with an exit opening from the container includes a hollow dispensing tip which encloses a fluid valve. The fluid valve utilizes a piston head which sealingly seats in a valve seat. A resilient biasing means holds the piston head in a normally sealed or closed position. A second opening in communication with the interior of the bottle is covered by a hydrophobic filter having a pore size that prevents microbial contaminants from entering the container but prohibits fluid from leaving the container. The bottle is squeezed to force fluid to overcome the biasing pressure of the fluid valve to dispense fluid from the bottle. Upon release of that pressure, the fluid valve closes and air passes through the filter to replace the dispensed fluid. The air entering the container is sterilized by the filter.

18 Claims, 5 Drawing Sheets

CONTAINER FOR DISPENSING PRESERVATIVE-FREE PREPARATIONS

BACKGROUND OF THE INVENTION

A. Field of the Invention

The present invention relates to fluid dispensing containers, and in particular, to containers useful for dispensing multiple dosages of fluids where the interior of the container is maintained in a sterile condition even when the fluid is preservative-free.

B. Problems in the Art

A variety of different ways exist to dispense fluids. A simple squeeze-bottle is a convenient and economical fluid dispenser. However, it is has disadvantages and even deficiencies in some situations.

For example, if the fluid to be dispensed contains ingredients which must be kept in a sterilized condition, an ordinary squeeze bottle presents the risk of contaminants entering through the outlet opening. Additionally, it presents the risk that air replacing dispensed fluid will contaminate the contents.

One approach to overcoming this problem is to add preservatives to the fluid to attempt to maintain the sterile conditions inside the container. Such things as germicidal agents are used in these preservatives A disadvantage of this approach is that the preservatives can contain substances which can detrimentally effect the use of the fluid. For example, fluids used in eye care and which contain germicidal agents can be irritating and even somewhat toxic to the user's eyes.

Two attempts to provide dispensing systems for fluids without utilizing preservatives are form, fill, and seal packaging, and aerosol containers. While these eliminate use of preservative substances, they also have problems and deficiencies.

The major problem with form, fill, and seal packaging, such as is known in the art, concerns what is called "suck back" with respect to the container. When fluid is being dispensed, pressure is exerted on the exterior of the container. When pressure is released, the negative pressure in the container pulls back whatever fluid is left in the outlet from the container. The risk is that microbial contamination, through airborne particles or direct contact with the fluid, will be pulled back into the container and destroy its sterility.

Aerosol containers are expensive and are difficult to control, especially when small quantities of material need to be dispensed. Additionally, the inherent structure of aerosol containers is prone to leakage of the propellant which can affect sterility and operation of the container. This is significant also with respect to limiting the shelf life of the fluid. Also, it is significant with respect to environmental concerns regarding leakage of propellants into the atmosphere.

There are a number of containers for dispensing fluids which are not aerosol containers or form, fill, and seal packaging containers. Examples of some of these containers can be found at:

U.S. Pat. No. 1,752,085 (Hinkle);
U.S. Pat. No. 2,812,117 (Butkus, et al.);
U.S. Pat. No. 3,952,902 (Prouty, et al.);
U.S. Pat. No. 4,159,790 (Bailey);
U.S. Pat. No. 4,259,954 (Scott);
U.S. Pat. No. 4,340,157 (Darner);
U.S. Pat. No. 4,533,068 (Meierhoefer).

While some of the above patents disclose fluid dispensing containers which do not have the above mentioned problems, there is still a need in the art for a container to dispense preservative-free fluids controllably, efficiently, and economically, and to store and maintain the fluids in a sterile condition.

Many of the above patents utilize ball valves or some type of a duckbill one-way valve. Some utilize these valves to prevent suck-back or to allow the entry or exit of air from the container. However, these type of valves are not sufficient to adequately insure maintenance of sterility of the inside and contents of the container, or to acceptably reduce the suck-back problem.

It is therefore a principal object of the present invention to provide a container for dispensing preservative-free preparations which solves or improves over the problems and deficiencies in the art.

A further object of the present invention is to provide a container as above described which maintains the sterility of the fluid within the container, both during storage and dispensing.

Another object of the present invention is to provide a container as above described which does not allow suck-back of fluid into the container after dispensing fluid from the container.

Another object of the present invention is to provide a container as above described which allows multiple dosages of variable quantities of the fluid to be dispensed.

A further object of the present invention is to provide a container as above described which seals the container from leakage and outside contaminants before and after dispensing of fluid.

A still further object of the present invention is to provide a container as above described which allows sterilized air to replace fluid dispensed from the container.

Another object of the present invention is to provide a container as above described which is easily sterilized before filling with fluid.

Another object of the present invention is to provide a container as above described which is easy to control so that precise amounts of fluid can be dispensed to a targeted area.

Another object of the present invention is to provide a container as above described which is economical, efficient, and durable.

These and other objects, features, and advantages of the present invention will become more apparent with reference to the accompanying specification and claims.

SUMMARY OF THE INVENTION

The present invention consists of a fluid-dispensing container which is especially useful for storing and dispensing preservative-free solutions. The container includes a bottle having a flexible side wall which is squeezable to dispense the fluid in desired quantities A fluid dispensing member, usually in the form of a cap means, is mountable to the bottle and has a dispensing tip containing a one-way valve. The valve is biased to a normally closed position The biasing force is directed against the direction of fluid flow out of the dispensing tip.

The container also includes an air inlet means positioned in communication with the interior of the container. The air inlet means includes a hydrophobic filter of selected pore size to allow air to pass into the bottle, but prevents microbial contaminating particles from passing into the bottle.

Fluid is dispensed by squeezing the bottle to build up sufficient fluid pressure to overcome the biasing force of the one-way valve. The hydrophobic filter does not let fluid out of the bottle while it is being dispensed, even if the fluid comes into contact with the filter. The filter allows sterile air to pass, but disallows contaminants and fluids to pass. This is accomplished by the minute pore size of the filter.

Once the desired amount of fluid is dispensed, squeezing pressure to the bottle is removed which results in a negative pressure in the bottle in the volume left by the dispensed fluid. The filter (if fully or partially not covered with fluid) allows air to pass through into the bottle to replace this area of negative pressure. The filter sterilizes the air, however, by removing any contaminants, including microbial contaminants. The pressure inside the bottle is therefore equalized and the bottle is ready for storage or a next dispensed dosage.

The one way valve seals the outlet tip when squeezing pressure is removed from the bottle It utilizes a movable biased piston head which seats within a valve seat. This combination effectively and reliably seals the fluid outlet and does so without allowing any suck-back of fluid in the tip back into the bottle.

The invention therefore allows a non-complex, economical structure to be utilized to store and dispense fluids. It is particularly useful with regard to fluids which are to be dispensed in different dosages over extended periods of time, and fluids which need to remain sterilized without containing preservatives. The invention eliminates the problems associated with aerosol containers and form, fill, and seal packaging. It also utilizes specific elements to allow dispensing of the fluid in a controlled, comfortable manner while having a reliable sealing valve and a reliable air inlet which maintains sterility of the container.

DETAILED DESCRIPTION OF THE PREFERRED EMBODIMENTS OF THE INVENTION

Figure 1:
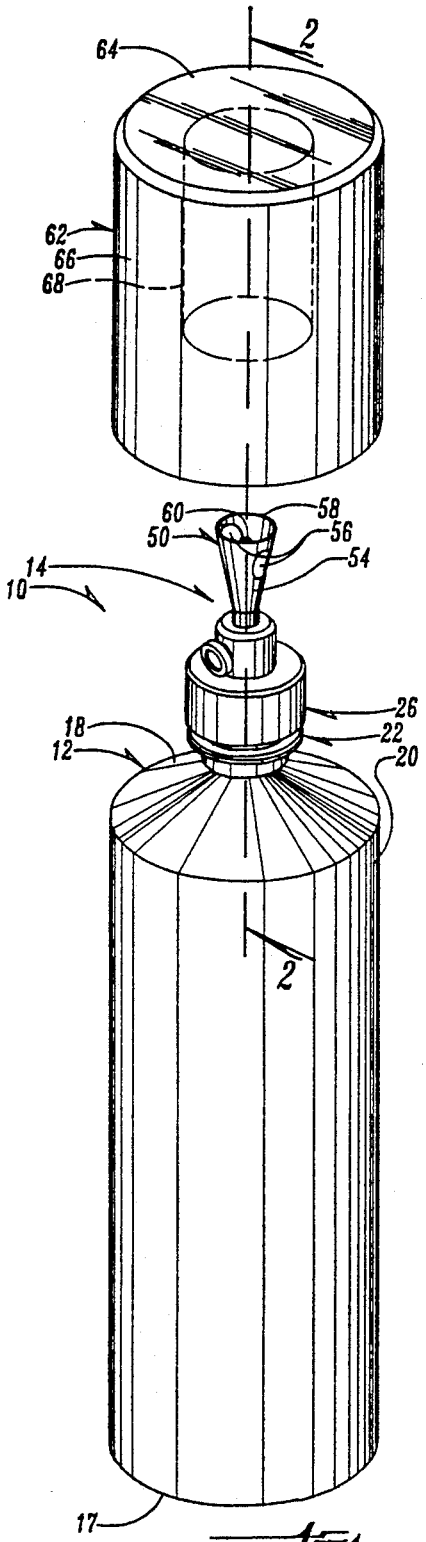
FIG. 1 is a perspective view of a first embodiment of the present invention, with an overcap shown in a removed position.

With reference to the accompanying drawings, a detailed description of the preferred embodiments of the present invention will now be set forth. This description is intended to aid in an understanding of the invention, but does not limit the invention, which is defined solely by the claims following this description.

Reference numerals are utilized to designate certain parts and features in the drawings. Like reference numerals will be utilized to designate like parts throughout the drawings, unless otherwise indicated.

Figure 2:
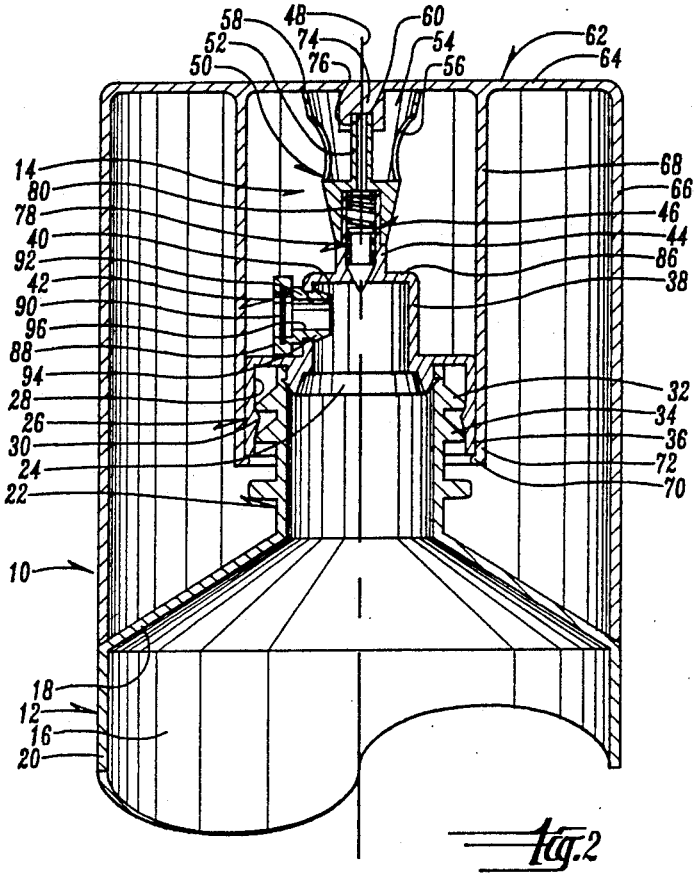
FIG. 2 is an enlarged cross-sectional elevational view of the upper portion of the container taken along line 2—2 of FIG. 1 with the removable overcap shown in an attached position.
Figure 3:
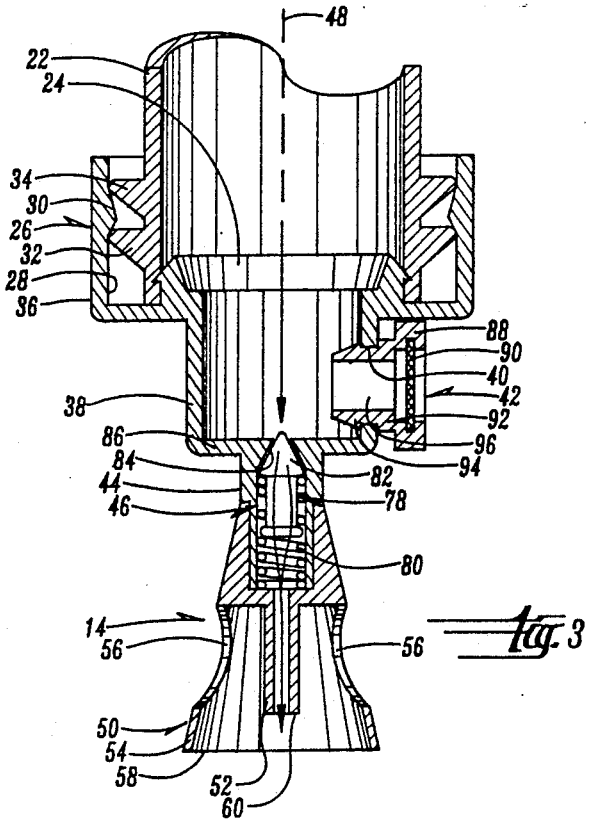
FIG. 3 is a still further enlarged cross sectional view of a portion of FIG. 2, but in an inverted position with the overcap removed.

A first embodiment is depicted with particular reference to the FIGS. 1-3. A container 10 is shown which includes a bottle 12 and a dispensing member or cap 14. The bottle 12 defines an interior chamber 16 which holds fluid to be dispensed. Bottle 12 includes a bottom wall 17, a top wall 18, and a continuous side wall 20. A tubular neck 22 defines an outlet opening 24 for fluid from chamber 16.

Cap 14 consists basically of a three-stepped or tiered hollow member 26 which is mountable onto tubular neck 22 of bottle 12. As is shown in FIG. 2, the interior vertical surface 28 of member 26 includes a raised edge 30 which cooperates with annular flanges 32 and 34 encircling tubular neck 22 of bottle 12, to allow cap 14 to be snapped onto tubular neck 22.

Member 26 is actually comprised of three sections of decreasing inside diameter. The first section 36 includes raised edge 30 and mounts upon tubular neck 22 of bottle 12. The second section 38 extends from the first section 36, has a smaller-in-cross-section inside diameter, and includes a side wall aperture 40 into which is insertable an air inlet plug 42.

The third section 44, having a still smaller interior cross-sectional diameter, extends from the second section and defines a chamber in which one-way valve 46 can be positioned.

Each of the first, second, and third sections 36, 38 and 44 are centered on a longitudinal axis identified by line 48 in FIGS. 2 and 3. The third section 44 is topped by a dispensing tip 50 which is secured by adhesive, sonic welding, or other means such as are known in the art. Dispensing tip 50 includes a fluid outlet channel 52 which communicates with the exterior of the bottle 12 and cap 14.

As can be seen in FIGS. 1-3, this embodiment includes a guard 54 surrounding fluid outlet channel 52 of dispensing tip 50. Guard 54 is basically an outwardly expanding conical annular member having apertures 56 disposed around its perimeter. The top edge 58 of guard 54 extends farther outwardly along line 48 from cap 14 than the top end 60 of fluid outlet channel 52 of dispensing tip 50. This provides somewhat of a shield deterring contaminants from coming into contact with the fluid outlet channel 52. Additionally, it prevents the top end 60 of fluid outlet channel 52 from easily abutting other objects, which also would present the undesired hazard of picking up contaminants.

FIGS. 1 and 2 also show an overcap 62 which can be removable mounted onto container 10. Overcap 62 includes a top wall 64 and a circular side wall 66. The interior of overcap 62 includes a circular annular wall 68 having an inwardly extending flange 70 around its end 72. Wall 68 and flange 70 cooperate to allow flange 70 to be snapped over cap 14 (see FIG. 2). Additionally, the interior side of top wall 64 of overcap 62 includes a projection 74 having a recess 76 in its center. Projection 74 is aligned along longitudinal axis 48 and receives, into a recess 76, top end 60 of dispensing tip 50. This arrangement occurs when overcap 62 is snapped onto container 10. It prohibits any fluid from passing out of dispensing tip 50, or allowing any contaminants into fluid outlet channel 52.

The components of container 10, in this preferred embodiment, are generally made from sterilizable plastic material. Bottle 12 is made of a plastic material so that at least side wall 20 is flexible. Bottle 12 can therefore be squeezed to control dispensing of fluid. Additionally, items such as cap 14 and overcap 62 can be made of a plastic material to allow resilient flexing of their walls to allow the snap-in mounting of these items. The components are easily sterilizable by, for example, steam autoclaving. Such processes as Gamma sterilization are not required, which can produce undesired substances that can cause irritation, if the fluid is used for eye care products, as an example.

One-way valve 46 of the embodiment of FIG. 1 is configured as follows. The hollow interior of third section 44 of annular member 26 of cap 14 surrounds a piston 78 and a biasing spring 80. The bottom portion of piston 78 includes a conically shaped piston head 82 having an angled surface which seats within a beveled valve seat 84 formed in wall 86, which separates the third section 44 from the second section 38 of annular member 26 and cap 14.

As can easily be appreciated, piston head 82 and valve seat 84 are shaped to matingly receive one another. This combination provides a very reliable fluid seal. It also allows very quick and controllable closing of fluid flow because of the shape and relationship of piston head 82 and valve seat 84.

Biasing spring 80, in this embodiment, is simply a metal coil spring. Piston 78 and spring 80 are inserted into the third section 44 of annular member 26 and held there by the securement of dispensing tip 50 to cap 14. Spring 80 is therefore normally in a state of partial compression and abuts against piston 78 to bias it in a normally closed and sealed position such as shown in FIG. 2. To dispense fluid, bottle 12 is squeezed (normally in an inverted or partially inverted orientation, such as in FIG. 3) to the point where the fluid pressure overcomes the biasing force of spring 80, pushing piston head 82 out of valve seat 84 (see FIG. 3) and allowing fluid to flow around piston 78 and out of fluid outlet channel 52. When the biasing force of spring 80 overcomes any fluid pressure upon piston head 82, (generally upon sufficient release pressure to bottle 10) piston head 82 will return into valve seat 84 and immediately and reliably close off the fluid flow. This operation of valve 46 does not result in any suck-back through fluid outlet channel 52, and minimizes any potential contaminants from entering back into bottle 12.

Air inlet plug 42, in the embodiment of FIGS. 1-3, comprises a generally circular plug head 88 into which can be positioned a filter 90. Plug body 92 includes an annular flange 94 at its outer end which allows the plug 42 to be snapped into aperture 40 in cap 14.

In the embodiment of FIG. 1, as well as in all embodiments described herein, filter 90 is a hydrophobic filter, such as is known in the art, which filters out any contaminants, including microbial contaminants. In this embodiment, filter 90 has a pore size of 0.2 microns, on the average, which accomplishes the function of allowing air to pass in either direction, but which is of a sufficient size to prevent contaminants from passing into bottle 12. Filter 90 also does not allow fluid to pass.

Air inlet plug 42 in this embodiment is situated on the side of cap 14 and includes passageway 96 through its length. Passageway 96 therefore provides fluid communication between the interior bottle 12 and the exterior.

In operation, container 10 is utilized to hold a fluid for even extended periods of time until a dosage is needed. In the stored position, overcap 62 is placed over cap 14 to provide further assistance in preventing against leakage or contamination.

When a dosage of fluid is desired, overcap 62 is removed, bottle 12 is generally tipped, or wholly or partially inverted, and bottle 12 is squeezed so that the fluid pressure overcomes the biasing pressure of spring 80. When the desired dosage is expelled form dispensing tip 50, the squeezing pressure is released and spring 80 pushes piston 78 so that piston head 82 seats in valve seat 84, immediately cutting off any access to the interior of bottle 12. The dispensing of fluid creates a subatmospheric pressure within bottle 12. Once fluid uncovers filter 90, air from the exterior of bottle 12 would be allowed to enter bottle 12, because of the lower pressure, and replace the dispensed fluid. The filter prevents any contaminants from entering the bottle and therefore preserves sterility of the bottle.

It can therefore be seen that the above described invention meets at least all of its stated objectives. It will be appreciated, however, that the present invention can take many forms and embodiments. The true essence and spirit of this invention are defined in the appended claims, and it is not intended that the embodiment of the invention presented herein should limit the scope thereof.

Figure 4:
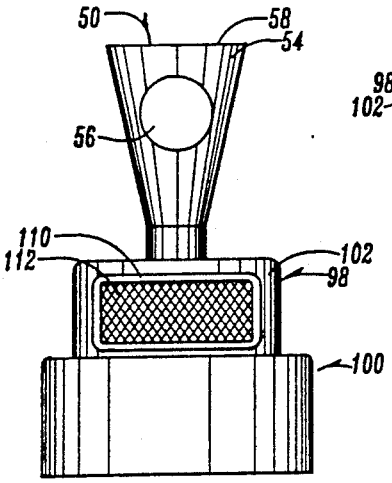
FIG. 4 is an elevational view of an alternative embodiment for a dispensing cap structure for the invention.
Figure 5:
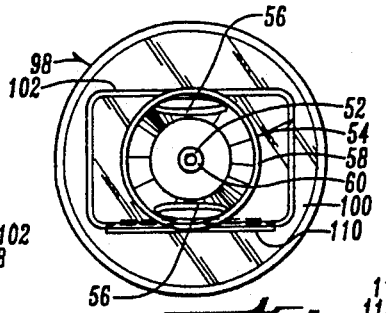
FIG. 5 is a top plan view of FIG. 4.
Figure 6:
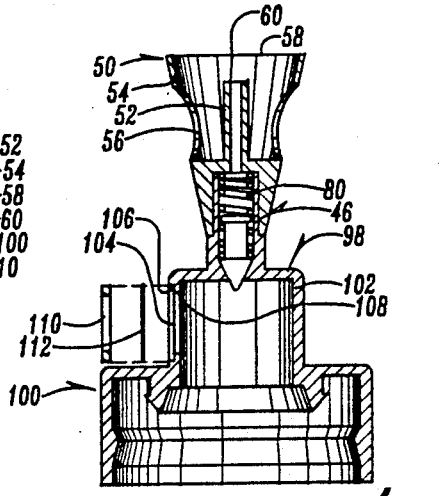
FIG. 6 is a side cross-sectional elevational view of the dispensing cap structure of FIG. 4 with a retaining ring and air filter shown detached therefrom.

For example, FIGS. 4-6 depict an alternative dispensing cap to that described with respect to FIGS. 1-3. In the embodiment of FIGS. 4-6, the second section 98 of cap 100 is configured to be rectangular in shape, rather than circular, as shown in FIGS. 1-3. The side wall 102 of second section 98 includes a rectangular-in-shape opening 104 which has an outer portion 106 of greater perimeter dimensions than an inner portion 108. Filter material 112 (hydrophobic, as previously described) can be mounted or seated in outer portion 106 to completely cover opening 104 so that any air passing through opening 104 would have to pass through filter material 112. Retaining ring 112 would then be fittable into outer portion 106 of opening 104 in cap 100 to hold filter 112 in place. Retaining ring 110 could be sonically welded into opening 104. This embodiment presents a somewhat larger filter area for air inlet into the bottle as compared with circular air inlet of FIGS. 1-3.

Further optional embodiments for components for the embodiment of FIG. 1 are shown in FIGS. 7-14. Instead of utilizing a separate biasing spring 80 and piston 78, such as shown in FIGS. 2, 3 and 6, the invention could utilize a combined piston head/biasing spring.

Figure 7:
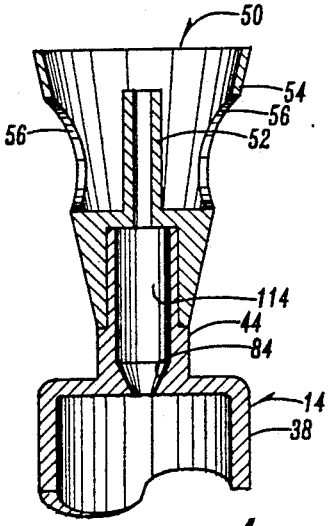
FIG. 7 is a partial cross-sectional elevational view of an alternative embodiment for a dispensing cap and tip for the invention.
Figure 8:
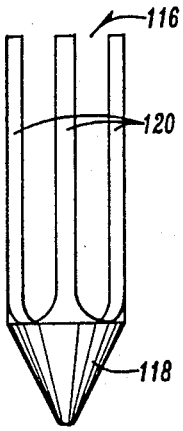
FIG. 8 is an enlarged elevational view of an alternative embodiment for a unitary valve piston and biasing means useful with the embodiment of FIG. 7.

FIG. 7 is a cross-sectional view of portions of cap 14 and dispensing tip 50 as shown in FIG. 2. However, instead of separate biasing spring 80 and valve 78, FIG. 8 shows a unitary valve piston 116 which includes conically shaped head 118, which can be positioned in the chamber 114 defined by third section 44 of tip 14. Extending parallelly in a direction opposite the front end of head 118 are a plurality of flexible and resilient legs 120. Valve piston 116 can be made in its entirety of a flexible and resilient material. Legs 120 would function similarly to biasing spring 80 of FIG. 2. When sufficient fluid pressure is exerted against head 118, legs 120 would bend and allow fluid to pass through beveled valve seat 84. When the fluid pressure is removed to the extent that it is exceeded by resilient restoring force of legs 120 to get back to their original shape, legs 120 would move head 118 to close off valve seat 84.

Figure 9:
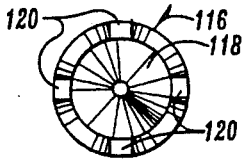
FIG. 9 is a top plan view of FIG. 8.

FIG. 9 shows a top view of valve piston 116 of FIG. 8, including the four legs 120 distributed in equal spaced apart positions around valve piston 116.

Figure 11:
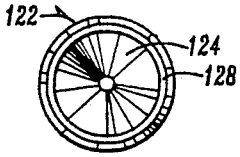
FIG. 11 is a top plan view of FIG. 10.
Figure 10:
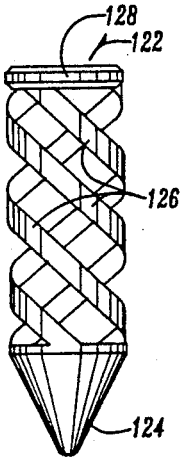
FIG. 10 is an enlarged elevational view of an alternative embodiment for a valve piston useful in the embodiment of FIG. 7.

FIGS. 10 and 11 show an alternative embodiment of a valve piston 122 which can be utilized in the cap/dispensing tip combination of FIG. 7. Valve piston 122 includes a conically shaped head 124 from which extend spiral-shaped, resilient members 126 to a ring 128. This arrangement would again allow functioning of the one-way valve according to the invention.

Figure 12:
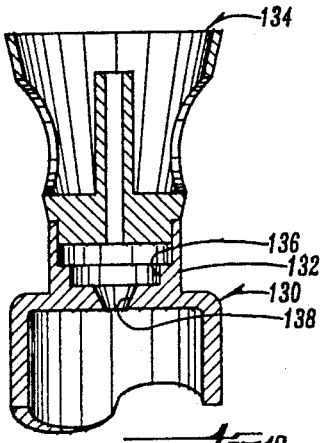
FIG. 12 is a partial cross-sectional elevational view of a still further embodiment for a dispensing cap and tip for the invention.
Figure 13:
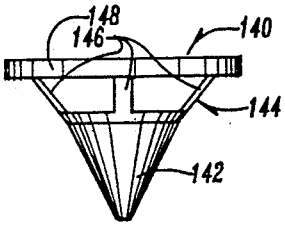
FIG. 13 is an enlarged elevational view of a valve piston useful in the embodiment of FIG. 12.
Figure 14:
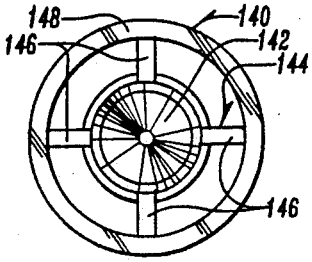
FIG. 14 is a top plan view of FIG. 13.

Finally, FIGS. 12-14 show a still further alternative embodiment for the one-way valve according to the invention. FIG. 12 discloses a dispensing cap 130 having a somewhat differently shaped third section 132. Additionally, the dispensing tip 134 seats partially within third section 132 rather than being mounted on its exterior (see FIG. 7 for example). A two-tiered bore 136 of increasing inside diameter exists on top of beveled valve seat 138.

As shown in FIGS. 13 and 14, a valve piston 140 is shaped to fit within two-tiered bore 136. Valve piston 140 consists of a conically shaped head 142, and a low-profile unitary spring 144 which includes a plurality of arms 146 extending outwardly at angles to a top ring 148. FIG. 14 shows a top view of valve piston 140. The spaces between arms 146 allow fluid to pass when head 142 is moved out cf sealing position in seat 138.

Figure 15:
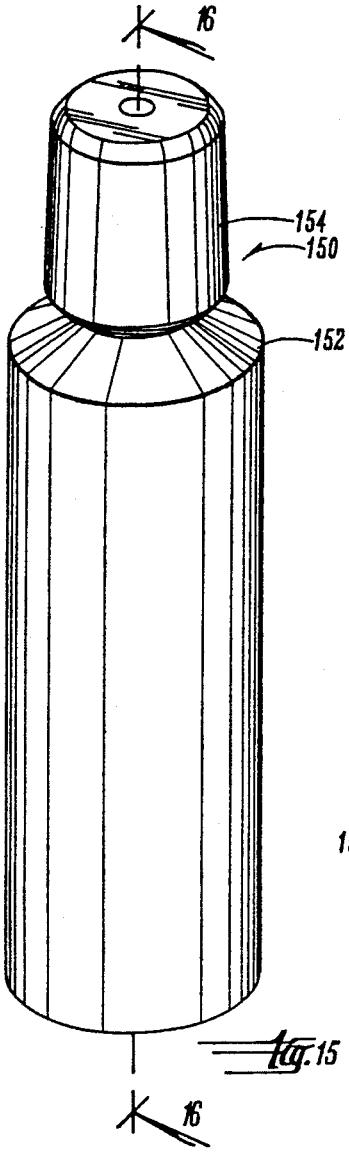
FIG. 15 is a perspective view of another embodiment according to the present invention.

FIG. 15 is a perspective view of a second embodiment of the invention which will be referred to generally by reference numeral 150. Embodiment 150 operates essentially the same as embodiment 10 of FIG. 1 except in the following ways.

As can be seen in FIG. 15, bottle 152 has an upper portion which can be enclosed by an overcap 154. The internal structure of overcap 154, and the dispensing portion of embodiment 150 can be more clearly seen in FIG. 16.

The top of bottle 152 includes neck 156 and outlet opening 158. The exterior of neck 156 has an annular stop member 160 and two parallel and adjacent annular rings 162 and 164.

A cap member 166 removably attaches to neck 156 over outlet opening 158 of bottle 152. Cap member 166 is comprised of basically five parts. First, cap portion 168 has a cylindrical side wall 170, lower edge 172, and upper covered end 174. Secondly, a member 176, which will be called a spring cup, is attachable to the interior of cap portion 168. Spring cup 176 encloses third and fourth items, namely piston 178 and spring 180. The fifth item is the hydrophobic filter 182, which is seated between spring cup 176 and cap portion 168.

Spring cup 176 can be secured to cap portion 168 by sonic welding or other means. Piston 178 and spring 180 are first loaded into bore 184 prior to attachment of spring cup 176 to cap portion 168. Similar to embodiment 10 of FIG. 1, the fluid outlet channel from bottle 152 extends through bore 184 to a fluid outlet channel 186 in dispensing tip 188 contained on the upper covered end 174 of cap portion 168. An annular guard 190, like guard 54 of embodiment 10 of FIG. 1, can also be included around dispensing tip 188.

Therefore, embodiment 150 also presents a spring biased piston 178 having a conically shaped piston head 192 which can be seated in a mating valve seat 194 in spring cup 176. Operation of this valve is the same as described with respect to embodiment 10 previously.

It is to be understood that cap member 166 is removably securable to neck 156 of bottle 152 by virtue of an interior annular ridge 196 around the interior cylindrical sidewall 170 of cap portion 168, which snaps into place between annular rings 162 and 164 on neck 156 of bottle 152. Annular stop member 160 on neck 156 limits how far down lower edge 172 of cap portion 168 can travel when attaching cap member 166 to bottle 152.

The exterior of cap portion 168 also has an annular ridge which can cooperate with an annular indent 200 in overcap 154 so that overcap 154 can be seated and snapped onto cap member 166. A plug member 202 extending downwardly from the center interior of overcap 154 can also seat into and plug up fluid outlet channel 186 and dispensing tip 180.

Figure 16:
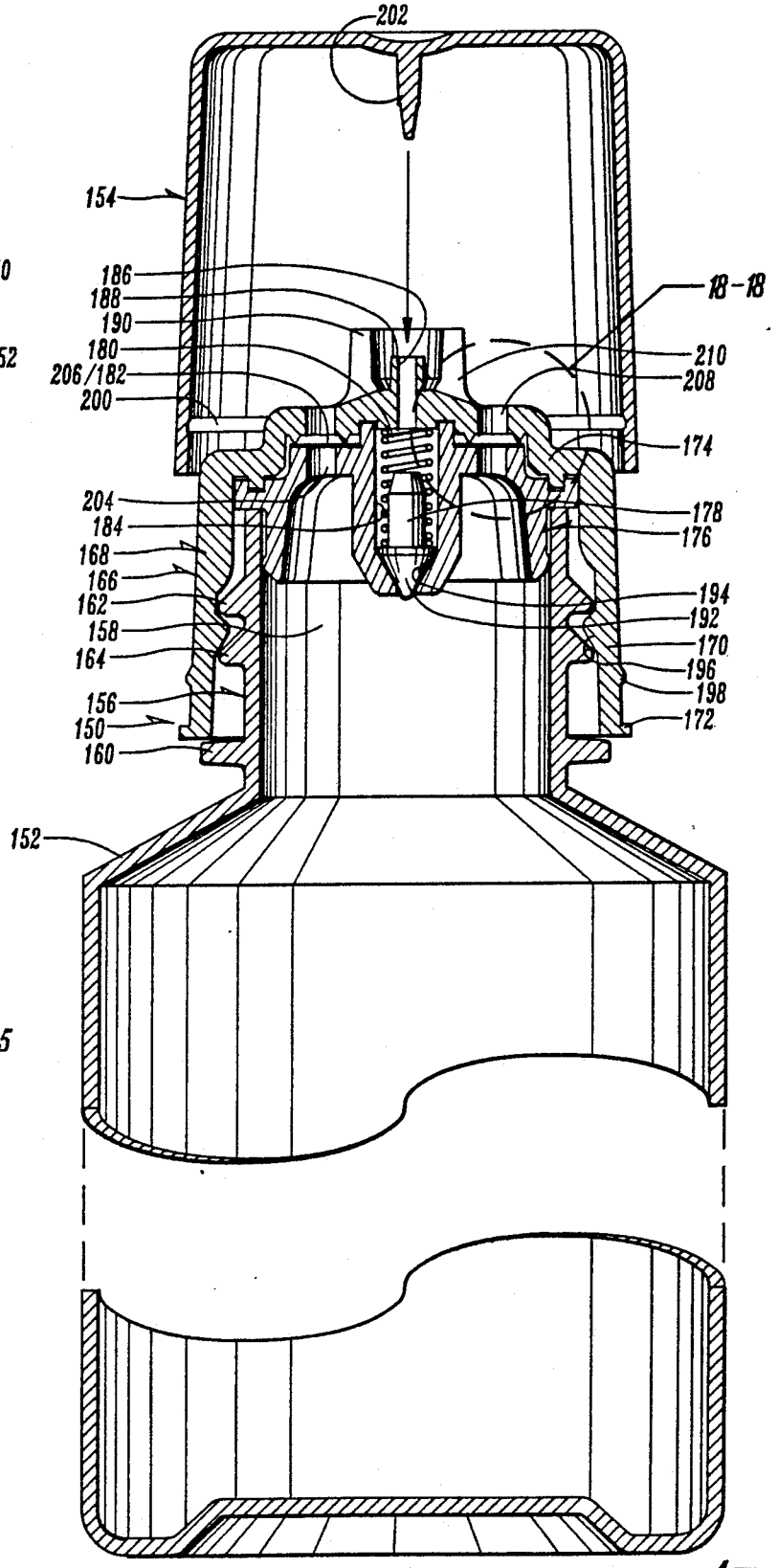
FIG. 16 is a sectional view taken along line 16—16 of FIG. 15.

The major difference of embodiment 150 from embodiment 10 of FIG. 1 is that instead of having the hydrophobic filter placed in a structure extending transversely to the longitudinal axis of the bottle and cap, in embodiment 150 the air inlet passages are parallel to that longitudinal axis. As can be seen in FIG. 16, a plurality of apertures 204 exist in spring cup 176 surrounding bore 184 containing pistons 178 and 180. A ring shaped hydrophobic filter 206 is then placed on top of apertures 204 prior to spring cup 176 being attached to cap portion 168. Openings 208 in upper covered end 174 of cap portion 168 therefore allow communication of air from outside embodiment 150 through filter 206 and apertures 204, into the interior of bottle 152.

Therefore, similarly to embodiment 10 of FIG. 1, fluid can be dispensed from bottle 152 only when sufficient pressure is exerted on the side walls of bottle 152 to overcome the biasing force of spring 180, opening valve formed between piston head 192 and valve seat 194. When the pressure is relaxed on the side wall of bottle 152 to the point that the biasing force of spring 180 can re-seat piston head 192, fluid flow through dispensing tip 188 will immediately cease and suck-back will be prevented.

If the plurality of apertures 204 are uncovered from fluid, air will be allowed to pass through openings 208 and filter 206 to equalize pressure within bottle 152 so that it is prepared for the next dispension of fluid. The filter 206, of course, similarly sterilizes the air coming in.

Figure 17:
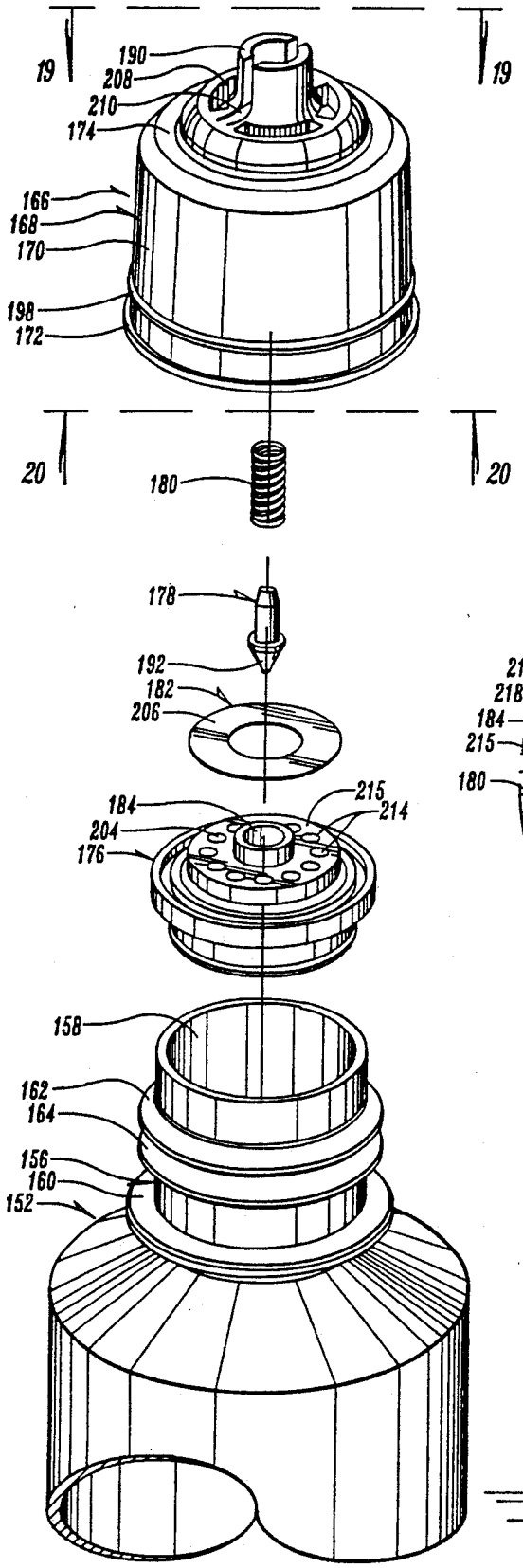
FIG. 17 is an exploded perspective view of the upper portion of the embodiment of FIG. 15.

FIGS. 17–20 show with more specificity the particular structure of embodiment 150. In FIG. 17, the structure of spring cup 176 in comparison to cap portion 168 can be more clearly seen. In particular, the plurality of apertures 204, in conjunction with ring shaped filter 206 in openings 208 can be more clearly seen. The structure reveals a relatively few number of parts can be combined to accomplish the advantages of the present invention. It is also noted that FIG. 17 shows drainage channels 210 on opposite ,sides of annular guard 190, surrounding dispensing tip 188, to allow any fluid which might accumulate in annular guard 190 to flow off. This further illustrates how the valving action quickly seals off fluid outlet channel 186 to prevent suck-back of fluid into bottle 152. Even though fluid may drain into openings 208 in cap member 166, the properties of filter 182 prevents fluid from entering bottle 152.

Figure 18:
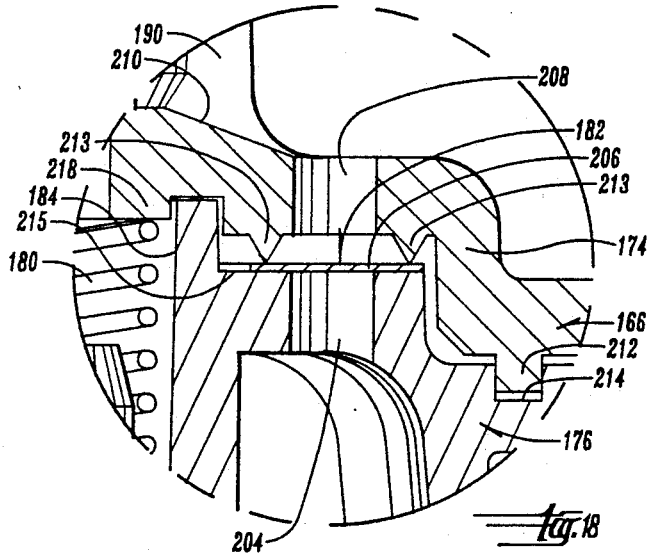
FIG. 18 is an isolated sectional view of the portion designated at line 18—18 of FIG. 16.

FIG. 18 shows with enlarged detail, first, a 360° rib 212 (see also FIG. 20) which seats within a 360° channel 214 in spring cup 176 (see FIG. 17). This combination allows secure adhesion of spring cup 176 to cap portion 168. In this embodiment, it is preferred that these parts be locked together by sonic welding.

FIG. 18 also shows in more detail how filter 182 is seated between cap portion 168 and spring cap 176. V-shaped in cross section rings 213 in cap portion 168 are positioned on opposite sides of apertures 204 and openings 208 and serve to clamp filter 206 against surface 215 of spring cup 176. FIG. 18 also shows how the upper end of spring 180 abuts a flat surface 216 of cap portion 168.

Figure 19:
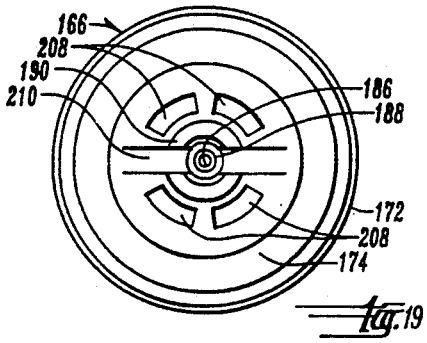
FIG. 19 is a top plan view taken along line 19—19 of FIG. 17.

FIG. 19 shows in more detail the openings 208 and drainage channels 210 of cap member 166. In this embodiment there are four openings 208 which are curved and disposed radially around dispensing tip 188 and annular guard 190.

Figure 20:
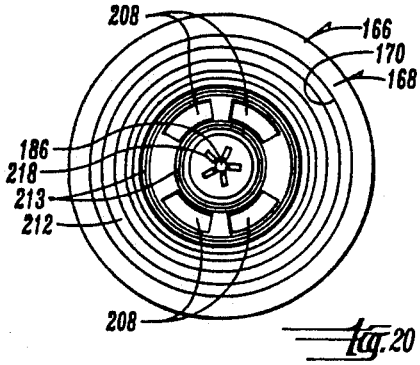
FIG. 20 is a bottom plan view taken along line 20—20 of FIG. 17.

FIG. 20 shows a bottom view of cap portion 168 of cap member 166, again showing the four openings 208. Five ribs 218 are shown which comprise the flat surfaces 216 which the upper end of spring 180 abuts. These ribs prevent the upper end of piston 178 from sealing off fluid outlet channel 186, as can be better appreciated by also referring to FIG. 16.

Figure 21:
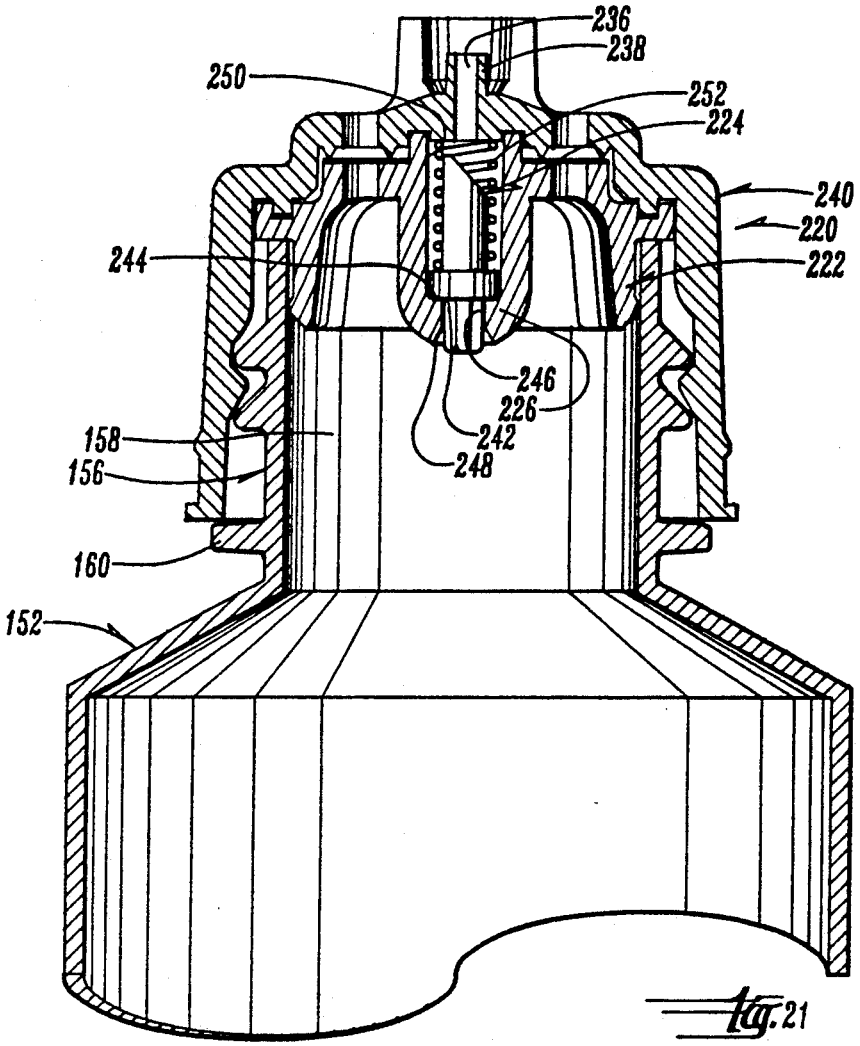
FIG. 21 is a partial sectional view, similar to the upper portion of FIG. 16, showing the preferred embodiment of the present invention.
Figure 22:
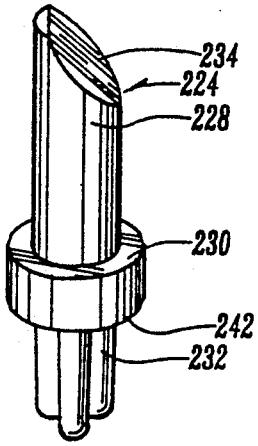
FIG. 22 is an isolated perspective view of the valve plunger of FIG. 21.
Figure 23:
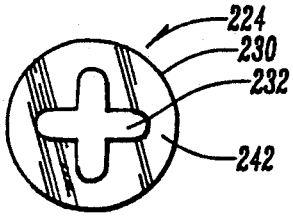
FIG. 23 is a bottom plan view of FIG. 22.

FIG. 21–23 depict a third embodiment 220 according to the present invention. It also functions basically the same in all respects to the previous embodiments 10 and 150 except as further pointed out below. It is to be understood that embodiment 220 is the preferred embodiment of the three disclosed herein. It is essentially equivalent to embodiment 150 in all respects except that it differs as to the structure of spring cup 222 in the following respects.

Piston 224 differs in shape as can be clearly seen in FIGS. 21–23. Additionally, valve seat 226 differs accordingly.

Piston 224 includes an upper cylindrical portion 228, a larger diameter annular portion 230, and a cross-shaped-in-cross-section piston head 232.

It can also be seen that upper portion 228 has a beveled upper end 234.

As can be appreciated, upper beveled end 234 prevents the upper portion 228 of piston 224 from closing off fluid outlet channel 236 in dispensing tip 238, even if piston 224 is pushed upwardly into abutment with cap portion 240.

Piston 224 operates in the same manner as previously described pistons but utilizes the flat surface 242 of annular portion 230 of piston 224 to seat against a mating flat surface 244 of spring cup 222.

Piston head 232 extends through opening 246 and spring cup 222. It is noticed that a flared portion 248 exists in opening 246, which has a larger diameter than other portions of 246.

The shape of piston head 232 is such that it allows fluid to pass through opening 246 into abutment with the lower surface of annular portion 230 even when the valve is closed. It is to be understood that annular portion 230 is less in diameter than bore 250 in which it moves. Upon even the slightest movement of annular portion 230 of piston 224 out of sealing relationship with surface 244, fluid can then pass through opening 246, and into bore 250 for dispension out of fluid outlet channel 236 in dispensing tip 238. However, conversely, when the biasing force of spring 252 overcomes fluid pressure against annular portion 230, annular portion 230 immediately seats and seals down against flat surface 244 stopping fluid flow, and immediately preventing any suck-back into the bottle through opening 246.

As with embodiment 150, the ring shape filter and air openings surrounding dispensing tip facilitate equalization of pressure inside the bottle after some fluid is dispensed.

What is claimed is:

1. A multiple dosage container for dispensing fluids comprising:

a bottle having an interior chamber defined by a bottom portion, a top portion, and a flexible side wall portion, and having an opening in the top portion;

fluid dispensing means secureable around the opening in the top portion of the bottle including, a hollow dispensing tip having a dispensing passage, a valve inside the fluid dispensing means beneath but aligned with the dispensing passage, the valve being movable between opened and closed positions but being resiliently biased in a direction opposite the dispensing passage by a biasing means to a normally closed position, thereby allowing flow through the fluid dispensing means form the bottle upon compressing the side wall portion of the bottle to the point where fluid pressure against the valve and towards the dispensing passage overcomes the biasing force of the biasing means, the valve including a valve guide defining a chamber having an open upper end substantially aligned with the dispensing passage, and a lower end defining a valve seat, the valve guide retaining a valve piston having a lower end comprising a valve head sealingly seatable within the valve seat, and which defines an opening to the bottle, and having an opposite end disposed towards the dispensing passage, the biasing means comprising a spring means contained within the valve guide and applying biasing force against an opposite side of the piston head from the valve seat, and means associated with the opposite end of the valve piston to prevent the opposite end of the valve piston from blocking the dispensing passage;

air inlet means including, one or more channels in fluid communication between the interior and exterior of the bottle, the channels positioned in the fluid dispensing means near the valve means, a hydrophobic filter positioned in each channel, the filter having a pore size that prevents airborne microorganisms from entering the bottle and fluid from leaving the bottle;

a dispensing tip guard positioned surrounding and extending outwardly a distance farther than the dispensing tip, and allowing fluid to pass from the dispensing tip externally of the tip guard, and so that air pressure in the bottle is equalized to the outside of the bottle when the valve is in the closed position, without contamination of the contents of the bottle, such-back through the fluid dispensing means into the bottle, or loss of fluid from the bottle and so that contact contamination with the dispensing tip is minimized by the tip guard.

2. The container of claim 1 wherein the fluids are preservative-free, non-aerosol preparations.

3. The container of claim 2 wherein the fluids include eye-care fluids.

4. The container of claim 3 wherein the fluids include preparations for care of contact lenses.

5. The container of claim 1 wherein the hollow dispensing tip extends generally outwardly along a longitudinal axis of the bottle, having a distal end and a proximal end.

6. The container of claim 1 wherein the spring means comprises a resilient coil spring.

7. The container of claim 1 wherein the valve head includes an annular member configured to sealingly seat against a flat surface surrounding the valve seat opening.

8. The container of claim 7 further comprising a cross-shaped-in-cross-section portion extending from the annular member through the valve seat opening.

9. The container of claim 1 wherein the valve head comprises a conically shaped member configured to sealingly seat within beveled sidewalls of the valve seat.

10. The container of claim 1 wherein the valve head is integrally formed with the biasing means,

11. The container of claim 10 wherein the spring means comprises a resilient material.

12. The container of claim 11 wherein the tip guard means further comprises fluid flow openings in a sheath surrounding the fluid passageway.

13. The container of claim 1 further comprising an overcap means movably securable over the fluid dispensing means and including stop means for preventing fluid flow from the fluid dispensing means when the overcap is in position on the container.

14. The container of claim 13 wherein the overcap means further comprises releasable securement means for securing the overcap to the container.

15. The container of claim 1 wherein the air inlet means comprises an opening into the container including a seat for the filter.

16. The container of claim 13 further comprising a holding means to secure the filter means in the seat.

17. The container of claim 1 wherein the air inlet means includes an air inlet path that is generally parallel to the flow through the fluid dispensing means.

18. The container of claim 1 wherein the air inlet means is associated with the side of the container.

* * * * *